US006031209A

United States Patent [19]

Wiesman

[11] Patent Number: 6,031,209

[45] Date of Patent: Feb. 29, 2000

[54] MAGNETIC POT HOLDER FOR A STOVE

[76] Inventor: Stephen F. Wiesman, 29890 Rousseau, Novi, Mich. 48377-2171

[21] Appl. No.: 09/048,752

[22] Filed: Mar. 26, 1998

[51] Int. Cl.[7] ..... H05B 3/68; F24C 15/30

[52] U.S. Cl. ..... 219/447.1; 126/24

[58] Field of Search ..... 219/443.1, 446.1, 219/447.1, 455.11, 518, 489; 366/146, 147, 273, 274; 126/24, 42, 90 A, 92 A

[56] References Cited

U.S. PATENT DOCUMENTS

| | | | |
|---|---|---|---|
| 2,878,803 | 3/1959 | Del Papa . | |
| 3,960,134 | 6/1976 | Scott . | |
| 4,108,140 | 8/1978 | Wolze . | |
| 4,217,482 | 8/1980 | Wadia | 219/489 |
| 4,448,186 | 5/1984 | Smith . | |
| 4,620,526 | 11/1986 | Tetschner . | |
| 4,934,333 | 6/1990 | Ducate, Jr. et al. . | |
| 5,410,128 | 4/1995 | Vermillion et al. | 219/455.11 |
| 5,549,382 | 8/1996 | Correia, II et al. | 366/144 |

*Primary Examiner*—Sam Paik
*Attorney, Agent, or Firm*—Kenneth L Tolar

[57] ABSTRACT

A new and improved device for retaining utensils on a stove top. The device includes an electromagnet spaced a predetermined distance below the stove burner or attached thereto. In a first embodiment, the electromagnet may be electrically connected to a control knob on a gas stove which is likewise connected to an electronic ignition system. Accordingly, activating the burner will simultaneously activate the magnet allowing a pot or pan to be magnetically secured thereto. In a second embodiment, the electromagnet is electrically connected to a control knob on an electric stove which activates the burner. Therefore, the electromagnet will be activated simultaneously with the burner to magnetically secure a pot or pan thereto. Either embodiment may include a separate switch means for selectively interrupting power to each of the magnets allowing a user to periodically manipulate the pot or pan.

7 Claims, 2 Drawing Sheets

MAGNETIC POT HOLDER FOR A STOVE

BACKGROUND OF THE INVENTION

The present invention relates to a magnetic pot holder for a stove, and more specifically, an electromagnet disposed immediately below a stove burner that is selectively activated with the burner control knob.

DESCRIPTION OF THE PRIOR ART

Cooking on a stove top poses a potential safety hazard in that a hot pot or pan may be easily knocked off the stove thereby scalding or severely burning an individual standing nearby. The potential hazard is further exacerbated when children are present who sometimes cannot resist grabbing the pot by its handle and pulling it off the stove. Retaining devices attachable to stove burners exist in the prior art. These devices typically relate to wire frames or sheet metal type receptacles which receive a pot or pan. For example, U.S. Pat. No. 4,934,333 issued to Ducate, Jr. et al describes a wire barrier mounted around the periphery of a standard stove top burner to prevent pots and pans from sliding off. The device is particularly designed for side cookers.

U.S. Pat. No. 4,448,186 issued to Smith discloses a device for increasing the efficiency of cooking on gas stoves comprising a first collar rigidly attached to a cooking utensil that mates with a second collar attached to the stove grid. The collars have several peripherally disposed vents which may be selectively aligned to control the venting of the stove flame.

U.S. Pat. No. 4,620,526 issued to Tetschner relates to a panel that fits on the top of a stove in a mobile vehicle for securing pots and pans. The panel has an opening for registering with the stove burner and has peripheral downturned flanges for securing the panel thereto.

U.S. Pat. No. 4,108,140 issued to Wolze relates to a coffee pot holder for use with a recreational vehicle stove comprising a unitary circular sheet for receiving a coffee pot. The sheet further has a plurality of integrally depending legs which are secured to the stove top rim.

U.S. Pat. No. 3,960,134 issued to Scott relates to a hollow cylinder for receiving and securing a cooking utensil on gas stoves. The cylinder is expandible and is attachable to the stove grate.

U.S. Pat. No. 2,878,803 issued to Del Papa relates to a stove grill utensil retainer comprising a securing assembly recessed in the bottom of the utensil allowing it to be removably attached to a second securing assembly mounted on the stove grill.

Each of the above described retaining devices has several disadvantages. The prior art retainers relate to collars, brackets or similar structures that protrude from the top wall of the stove. Accordingly, the devices are unsightly and obtrusive. The retaining devices themselves pose a safety hazard since they are made from a conductive material and therefore will be heated by the burner whenever the burner is activated. Because the retainers rest on the stove top exterior, they may be inadvertently touched by a passerby resulting in a serious burn. Finally, inserting and removing a utensil from a cage type receptacle is cumbersome and inconvenient. The present invention overcomes these disadvantages by providing an electromagnet that is disposed immediately below or integral with the stove grill for magnetically securing the pot or pan thereto. The electromagnet is in communication with the burner control knob and is thereby simultaneously activated when the burner is activated.

SUMMARY OF THE INVENTION

The present invention relates to a new and improved pot or pan retaining device for a stove top. A first embodiment includes an electromagnet placed immediately below the burner on an electric stove by attaching it to the peripheral edge of the grill opening or by simply placing it on the drip pan therebelow. The electromagnet is electrically coupled with the burner control knob. Accordingly, when power is delivered to the burner, power will be simultaneously delivered to the electromagnet thereby activating said magnet whenever the burner is activated. Alternatively, the electromagnet may be rigidly or integrally secured to the burner preferably in a central portion thereof. In a second embodiment, the electromagnet is attached to the gas burner found on a typical gas stove. The electromagnet is electrically coupled to the electronic ignition system on the gas stove such that when the gas burner is activated with its corresponding control knob, the electromagnet will likewise be activated. The magnets may also be in communication with a separate switch means for temporarily deactivating the magnets allowing a user to intermittently manipulate the pan. It is therefore an object of the present invention to provide a retaining device for a stove which will magnetically secure a pot or pan to a stove burner.

It is yet another object of the present invention to provide a retaining device for a stove that is selectively activated with a burner control knob.

It is yet another object of the present invention to provide a magnetic retaining device for a stove that may be temporarily deactivated. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
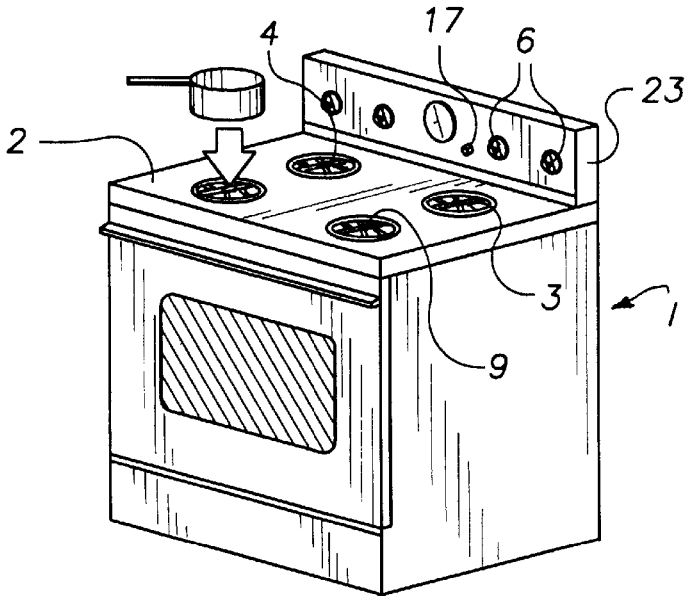
FIG. 1 depicts a gas stove.
Figure 2:
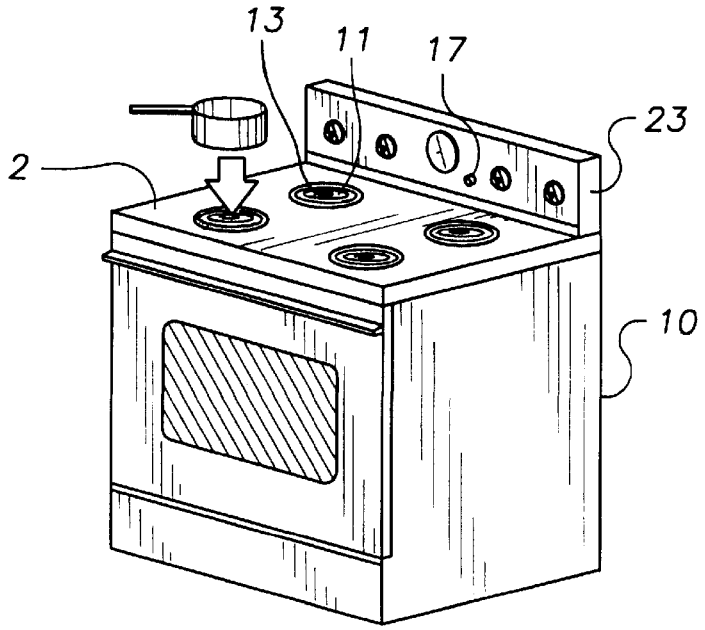
FIG. 2 depicts an electric stove.
Figure 3:
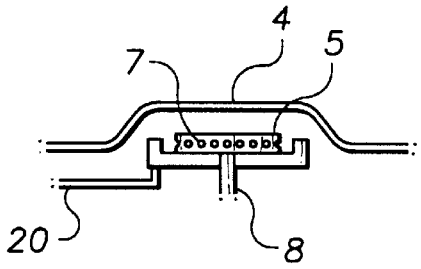
FIG. 3 is a cross sectional side view of a first embodiment of the inventive device.
Figure 4:
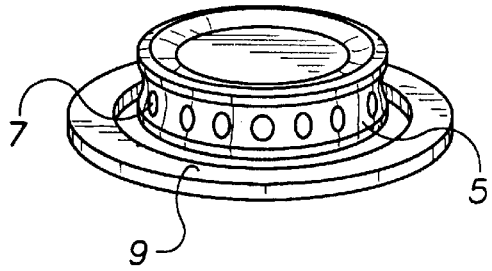
FIG. 4 is a perspective view of an electromagnet attached to the bottom surface of a gas burner according to a first embodiment of the inventive device.

Referring now to FIGS. 1 through 7, the present invention relates to a retaining device for a stove top to secure pots and pans thereto. A stove 1 typically includes a top wall 2 having a plurality of apertures 3 thereon each for receiving a burner grill 4 on which a pot or pan is placed. A first embodiment according to the present invention relates to a retaining device specifically configured for gas type stoves having a substantially circular burner 5 immediately below the grill 6 having a circular sidewall, a bottom surface and a top surface. Disposed on the sidewall are a plurality of apertures 7 in communication with a gas supply line 8. Each burner is selectively ignited with a designated control knob 6 that activates an internal electronic ignition system (not pictured). A first embodiment according to the present invention relates to a securing device to be used with a conventional gas stove as described above.

Figure 5:
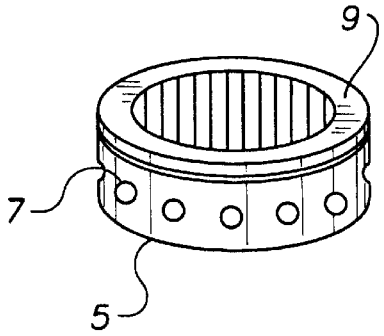
FIG. 5 depicts the first embodiment according to the present invention attached to the upper surface of a gas burner.
Figure 6:
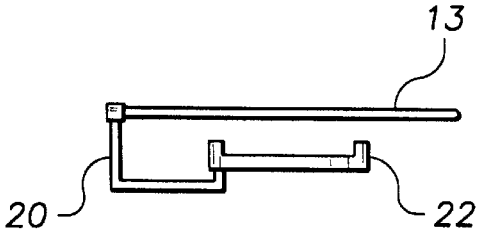
FIG. 6 is a cross sectional side view of a second embodiment according to the present invention.

The device includes an annular electromagnet 9 having a base portion surrounding and peripherally attached to the bottom surface of the burner. Alternatively, the magnet may be rigidly or integrally attached to the top surface of the burner as depicted in FIG. 5 thereby concentrating the magnet field at the center of a pan in which case the magnet may be disc shaped, annular or any other shape which allows it to be attached to the upper surface of the burner. Alternatively, the magnet may be secured to a central portion of the grill itself as indicated in FIG. 1. The electromagnet 9 is of the type generally know in the prior art and typically includes a plurality of wound copper wire coils injection molded into a high density silicone type rubber assembly or a similar heat and melt resistant material. The electromagnet 9 is electrically coupled to the gas stove electronic ignition system (not pictured) such that when a burner is activated with its respective control knob, electrical power from the ignition system is simultaneously delivered to the electromagnet. Accordingly, when a pot or pan is placed on the activated burner, it will be magnetically secured thereto.

Figure 7:
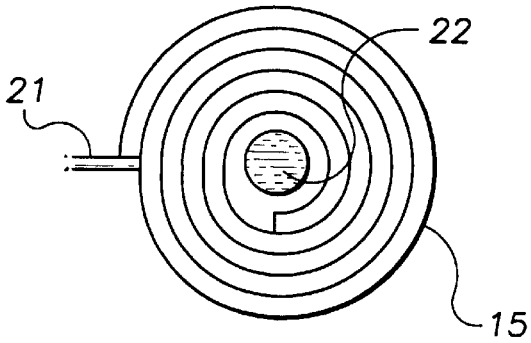
FIG. 7 depicts a top view of an electric burner with the electromagnet according to the present invention attached to the central portion thereof.

A second embodiment according to the present invention may be used in conjunction with an electric stove 10. An electric stove likewise has a top wall with a plurality of apertures 11 thereon each for receiving a grill 13. The grill comprises a spiraled type heating element 15 typically having a central opening or disc thereon electrically connected to a discrete control knob 14 on the stove exterior. A terminal end 21 of the grill is typically connected to a plug type receptacle received within the stove aperture. The present invention includes an electromagnet 22 similar to that described above spaced below the electric burner. The device may rest on the drip pan that is typically placed below the grill or may be attached to the plug type receptacle or the lower surface of the stove top wall. The magnet may also be attached to the peripheral edge of the grill apertures using any conventional attachment means. Alternatively, the electromagnet may be imbedded or received within the central opening of the spiraled heating element as depicted in FIG. 7 to concentrate the magnetic field generated thereby at the center of a pot or pan. Accordingly, whenever the heating element 15 is activated with its respective control knob, power will also be delivered to its corresponding electromagnet.

Each of the electromagnets according to either embodiment described above may also be connected in series or in parallel to a switch means 17 for selectively interrupting the power thereto. The switch means is preferably disposed on the burner control panel 23 that perpendicularly extends from the top wall of the stove. The switch means 17 would be of the type generally known in the prior art and preferably includes a spring biased button which, when depressed, interrupts power to each of the electromagnets. Preferably the switch means 17 would also have a locking means thereon for permanently disabling power. Accordingly, a user may activate the switch means to temporarily disconnect power to a magnet allowing the user to intermittently manipulate the pot or pan.

The present invention is not to be limited to the exact details described above. Although the electromagnet has been depicted and described above as annular or disc shaped, the magnet may have any shape, design or size without departing from the spirit of the present invention. Furthermore, each magnet may be attached to the stove grill, the grill aperture sidewall, the burners or any other location as long as the magnet is sufficiently proximal the grill to magnetically secure a pot or pan thereto. Any suitable conventional attachment means may be used to secure the magnets to any of the above described locations. The magnets are electrically connected to their respective control knobs using conventional wiring 20 and connectors (not pictured) or any other conventional means.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with an electric stove having a top wall with a plurality of apertures thereon each for receiving an electric grill having an upper surface on which a pan or pot rests, with a drip pan therebelow, each of said grills acuatable with a control knob on a control panel depending from said top wall, a retaining device comprising:

an electromagnet means attached to the upper surface of said electric grill for magnetically attracting said utensil to retain said utensil on said grill, said magnet electrically connected to said control knob whereby said electromagnet is activated simultaneously with said electric grill.

2. A retaining device according to claim 1 further comprising a switch means in communication with said electromagnet and said control knob for temporarily disabling power thereto.

3. A retaining device according to claim 2 wherein said switch means is disposed on said control panel.

4. In combination with a gas stove having a top wall with a plurality of apertures thereon each aperture having a gas burner therein, said gas burner having an upper surface and a grill thereabove for supporting a cooking utensil, a plurality of control knobs on a control panel depending from said top wall each in communication with a discrete electronic ignition means for selectively activating a predesignated burner, a retaining device comprising: an electromagnet means attached to the upper surface of said gas burner for magnetically attracting said utensil to retain said utensil on said grill; said magnet electrically connected to a discrete control knob whereby said control knob simultaneously activates said electronic ignition means and said electromagnet means.

5. A retaining device according to claim 4 further comprising a switch means in communication with said electromagnet means and said control knob for selectively interrupting power to said electromagnet means.

6. A retaining device according to claim 5 wherein said switch means is disposed on said control panel.

7. In combination with a gas stove having a top wall with a plurality of apertures thereon, each aperture having a gas burner therein and a grill thereabove for supporting a cooking utensil, each of said grills having an upper surface, a plurality of control knobs on a control panel depending from said top wall each in communication with a discrete electronic ignition means for selectively activating a predesignated burner, a retaining device comprising:

an electromagnet means attached to the upper surface of said grill for magnetically attracting said utensil to retain said utensil on said grill, said magnet electrically connected to a discrete control knob whereby said control knob simultaneously activates said electronic ignition means and said electromagnet means.

* * * * *